United States Patent [19]

Barlow

[11] Patent Number: 4,570,693

[45] Date of Patent: Feb. 18, 1986

[54] METHOD OF SQUEEZE FORMING METAL ARTICLES

[75] Inventor: John Barlow, Willenhall, England

[73] Assignee: GKN Technology Limited, Wolverhampton, Great Britain

[21] Appl. No.: 681,997

[22] PCT Filed: Apr. 18, 1984

[86] PCT No.: PCT/GB84/00130

§ 371 Date: Dec. 7, 1984

§ 102(e) Date: Dec. 7, 1984

[87] PCT Pub. No.: WO84/04264

PCT Pub. Date: Nov. 8, 1984

[30] Foreign Application Priority Data

Apr. 26, 1983 [GB] United Kingdom ..... 8311262
Apr. 26, 1983 [GB] United Kingdom ..... 8311264

[51] Int. Cl.[4] ..... B22D 19/00; B22C 1/08

[52] U.S. Cl. ..... 164/112; 164/120; 164/320; 164/520; 164/522

[58] Field of Search ..... 164/6, 15, 37, 39, 40, 164/170, 171, 522, 520, 120, 320, 112; 419/68

[56] References Cited

U.S. PATENT DOCUMENTS

| | | | |
|---|---|---|---|
| 3,439,732 | 4/1969 | Andreoli | 164/112 |
| 3,801,334 | 4/1974 | Dewey, Jr. | 164/522 |
| 4,334,507 | 6/1982 | Köhnert et al. | 164/120 |
| 4,446,906 | 5/1984 | Ackerman et al. | 164/112 |
| 4,480,681 | 11/1984 | Alexander et al. | 164/522 |

FOREIGN PATENT DOCUMENTS 1274966 5/1972 United Kingdom .

OTHER PUBLICATIONS

Jones, W. D., *Fundamental Priciples of Powder Metallurgy*, pp. 337–339, 1960.

*Primary Examiner*—Nicholas P. Godici
*Assistant Examiner*—Samuel M. Heinrich
*Attorney, Agent, or Firm*—Marshall, O'Toole, Gerstein, Murray & Bicknell

[57] ABSTRACT

A squeeze formed aluminum alloy article, such as a piston, is formed with a re-entrant cavity (14) by locating an isostatically compacted salt core (10) in the mould cavity of the squeeze forming press prior to introduction of the molten metal therein. The core (14) is subsequently dissolved from the squeeze formed article to provide a corresponding shape to the article which does not require subsequent machining.

13 Claims, 7 Drawing Figures

METHOD OF SQUEEZE FORMING METAL ARTICLES

This invention relates to the manufacture of articles by the technique known variously as squeeze forming, squeeze casting or extrustion casting which for the sake of convenience throughout this specification and claims will be referred to as "squeeze forming". Basically the technique of squeeze forming comprises introducing liquid metal into a first part of a mould, closing the mould under pressure so that the liquid metal is displaced by the mould closure to fill a cavity within the mould without entrapping air, maintaining the metal under pressure whilst solidification takes place so as to ensure that any shrinkage cavities which may form are closed and filled, and then opening the mould and removing the formed article.

It is known to produce various squeeze formed articles, usually of aluminium or aluminium alloys, but such articles have generally been of a fairly simple shape. Thus where a more complex shape is required it would generally be necessary to achieve such shape by some form of machining operation subsequent to manufacture of the squeeze formed article.

It is an object of the present invention to provide an improved method of manufacturing an article by squeeze forming whereby a more complex shape may be provided to the article without the necessity of extensive subsequent machining.

In accordance with the invention there is provided a method of manufacturing a metal article by squeeze forming comprising locating a shaped compacted soluble salt core in a mould part of a squeeze forming press prior to the introduction of molten metal into the mould, the core being compacted to such a density and surface finish that it will retain its integrity during the squeeze forming operation and being of a shape required to be formed in the squeeze formed article; introducing molten metal into the mould; closing the mould under pressure so that molten metal is displaced by the mould closure to fill a cavity in the mould within which the shaped core is located; maintaining the metal under pressure whilst solidification thereof takes place; opening the mould; and dissolving the shaped core from the squeeze formed article.

Conveniently such a shaped soluble core can be utilised to provide a re-entrant recess or through bore in the squeeze formed article. By way of example, such core may be shaped to provide a re-entrant bowl in the crown of an internal combustion engine piston or, again, by way of example, such core may be shaped to provide a through bore in a link of an endless track assembly.

The said salt core is conveniently isostatically compacted either to the required shape or substantially to the required shape and is then machined. The molten metal conveniently comprises a light metal such as aluminium, magnesium or an alloy thereof.

The method of the invention is conveniently applicable to the manufacture of a light metal piston for an internal combustion engine wherein the piston is squeeze formed crown down in a squeeze forming press having a bottom mould part and a cooperating top punch vertically movable relative to one another, the shaped core being located in the bottom mould part and being so shaped as to form a bowl in the piston crown.

Conveniently the core is so shaped as to provide a re-entrant bowl configuration in the piston crown.

In order to prevent pick-up of moisture in the salt core, it is preferable to add a desiccant thereto which will thus provide free-flowing characteristics to facilitate a closer packing of the salt during its isostatic compaction ensuring a dense compact. The desiccant may comprise magnesium carbonate or magnesium phosphate in a proportion of approximately 0.1 percent by weight of the core. Obviously a desiccant must be chosen which does not decompose at the forming temperature of the metal which, for aluminium, is within the range 680° C. to 750° C. The salt together with the desiccant is preferred to have all of the following properties:

1. The material must be easily formed to the required shape.
2. The material must be strong enough to withstand handling and the temperature and pressure requirements of the squeeze forming process.
3. The material must be easily soluble (preferably in water) to facilitate removal of the core from the formed article.
4. The solution of the core material should have little or no corrosive attack on the metal.
5. The material should preferably be recoverable for recycling.

It is preferred to use fine grained sodium chloride having a particle size between 5 and 250 microns which material, together with the desiccant, may be readily cold isostatically compacted to shape at a pressure of approximately 30,000 p.s.i. (207 MPa). It is not necessary to carry out any subsequent sintering operation on the isostatically compacted salt and desiccant.

Additionally, it is preferable to add an expansion modifying agent to the core material in order to reduce, or eliminate the incidence of thermal stress cracking in the salt during the squeeze forming operation. Such an expansion modifying agent may comprise, for example, aluminium, oxide, glass powder, a copper alloy infiltrant, graphite talc or fine alumino-silicate fibres.

Other features of the invention will become apparent from the following description given herein solely by way of example with reference to the accompanying drawings wherein.

Although the method of the invention is applicable to the squeeze forming of any metal article having a required, usually complex, shape to be formed therein without the necessity for subsequent machining of such shape, the following description is given only with reference to the drawings which relate to the production of a piston for an internal combustion engine. Such a piston is usually formed of aluminium or an alloy thereof although it may also be formed of magnesium or an alloy thereof.

The piston is formed in a squeeze forming press (not illustrated) which will usually comprise a bottom mould part and a cooperating top punch vertically movable relative to one another. The bottom mould part may be stationary and the top punch may be reciprocable into and out of cooperation with the bottom mould part which itself may include two or more laterally movable mould parts securable in closed relation with one another to define a mould cavity with the bottom mould part. In the embodiment illustrated herein, the piston includes two ferrous expansion inserts incorporated in the squeeze formed piston and, during the squeeze forming operation, such expansion inserts may conveniently be located on the top punch by means of button magnets embedded within the punch on the side walls thereof.

Figure 1:
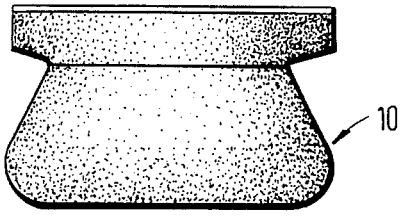
FIG. 1 is a side elevation of a shaped isostatically compacted salt core for forming a re-entrant bowl in a piston crown.

The piston is formed in the crown down position with one or more bowl shaped cavities in the crown, such cavity of cavities being formed by the provision of the shaped salt core 10 of FIG. 1 which is located in the bottom mould part to project upwardly from the bottom surface thereof.

The salt core 10 is formed by cold isostatic compaction in a urethane or rubber elastomeric bag in a liquid to which pressure is applied of approximately 30,000 p.s.i. (207 MPa). The salt is fine grained sodium chloride having a particle size of between 5 and 250 microns and is mixed with a desiccant material which may comprise magnesium carbonate or magnesium phosphate. An expansion modifying agent is also added to the mixture, such agent comprising, for example, aluminium oxide, glass powder, a copper alloy infiltrant, graphite, talc or fine alumino-silicate fibres. By this process of cold isostatic compaction a shaped salt core may be readily formed to the configuration shown in FIG. 1 of the drawings and will have sufficient integrity to resist the pressures to which it is subjected during the squeeze forming operation and will have such a surface finish as to form a corresponding shaped surface in the squeeze formed piston which will not require any subsequent machining.

The core 10 illustrated in FIG. 1 is compacted and is tne subsequently machined to the final shape shown. However, it is possible, depending upon the complexity of the shape required, to compact the core to such required final shape without the need of any subsequent machining operation.

The core 10 of FIG. 1 is located in the bottom mould part of the squeeze forming press, the expansion inserts are magnetically secured to the top punch, the laterally movable bottom mould parts are locked together and molten aluminium is then metered into the mould cavity. The top punch is then brought into cooperating engagement with the mould cavity to displace the molten aluminium to fill the cavity defined between the punch and the bottom mould part and the aluminium is maintained under pressure of approximately 10,000 p.s.i. (70 MPa) whilst solidification takes place. The mould is then opened, the squeeze formed piston is removed and the shaped salt core is dissolved from the piston by for example, jetting with warm water.

Figure 2:
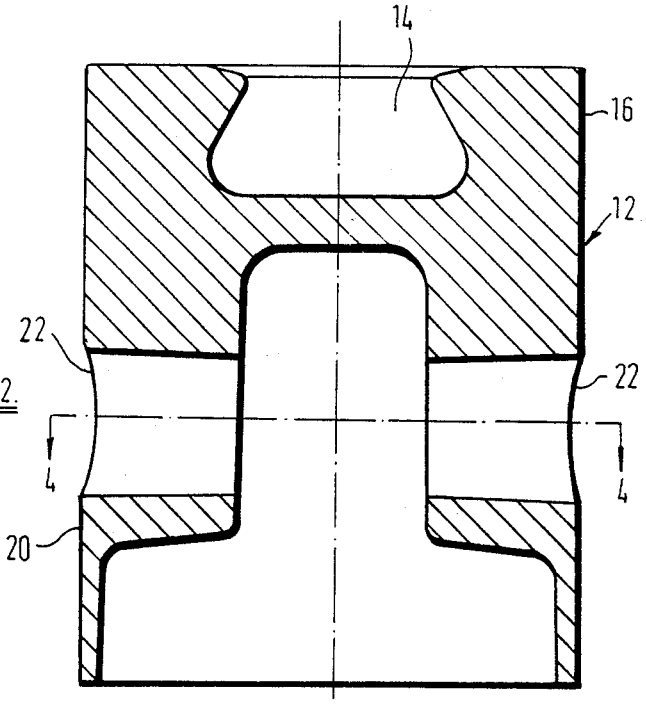
FIG. 2 is a longitudinal cross sectional view of an aluminium squeeze formed piston in the as-formed condition showing the re-entrant bowl formed by the shaped core of FIG. 1.
Figure 3:
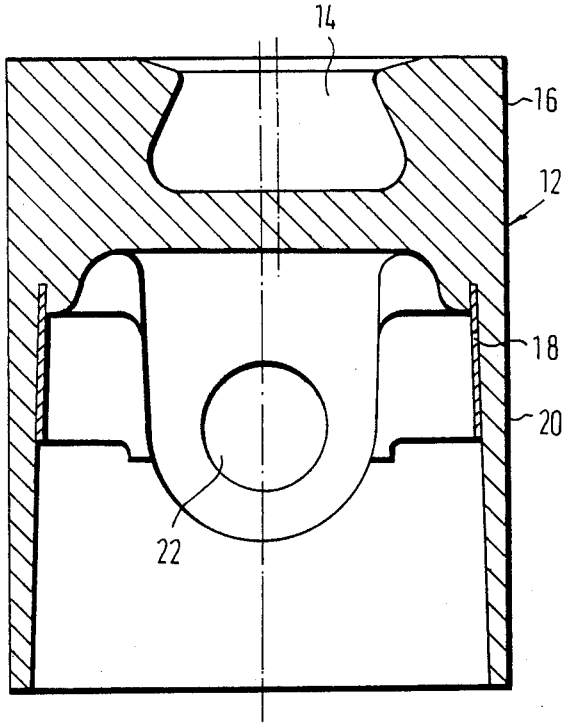
FIG. 3 is a similar longitudinal cross sectional view to that shown in FIG. 2 but taken at 90° thereto.
Figure 4:
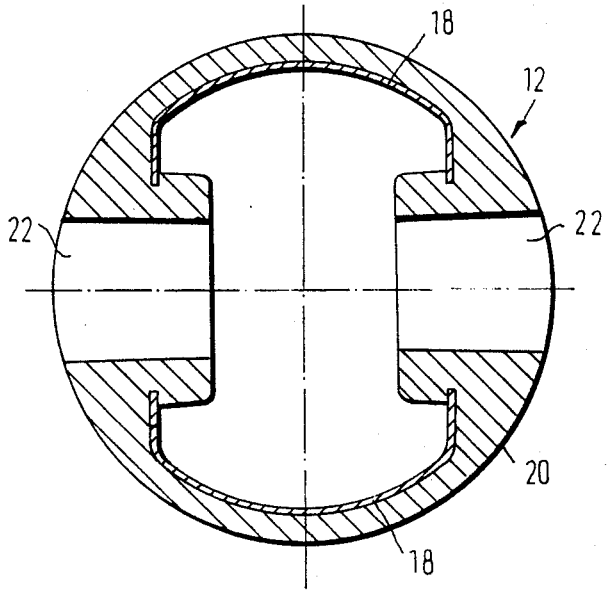
FIG. 4 is a transverse cross sectional view on the line 4—4 of FIG. 2.

The as-formed piston 12 is shown in FIGS. 2, 3 and 4 of the drawings wherein it will be seen that a re-entrant bowl 14 has been formed in the crown 16 of the piston. The shape and surface finish of this bowl 14 are such as not to require any further machining operations to be carried out thereon. Also, as will be clearly seen from FIGS. 3 and 4, the ferrous expansion inserts 18 are incorporated in the skirt portion 20 of the piston. Also as will be particularly seen from FIG. 2, diametrically opposed bores 22 are formed in the skirt portion 20 (formed by appropriate core rods in the laterally movable mould portions of the squeeze forming press) at the location at which a through bore is to be machined for the reception of a gudgeon pin.

Figure 6:
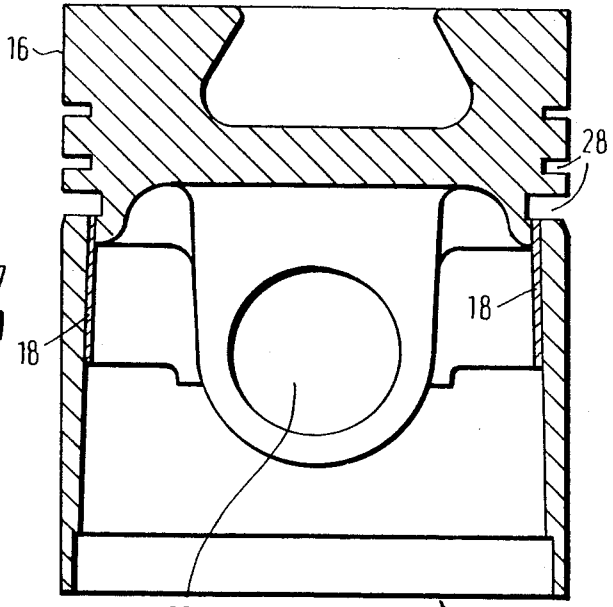
FIG. 6 is a similar longitudinal cross sectional view of the finished piston of FIG. 5 but taken at 90° thereto and FIG. 7 is a transverse cross sectional view on the line 7—7 of FIG. 5.
Figure 5:
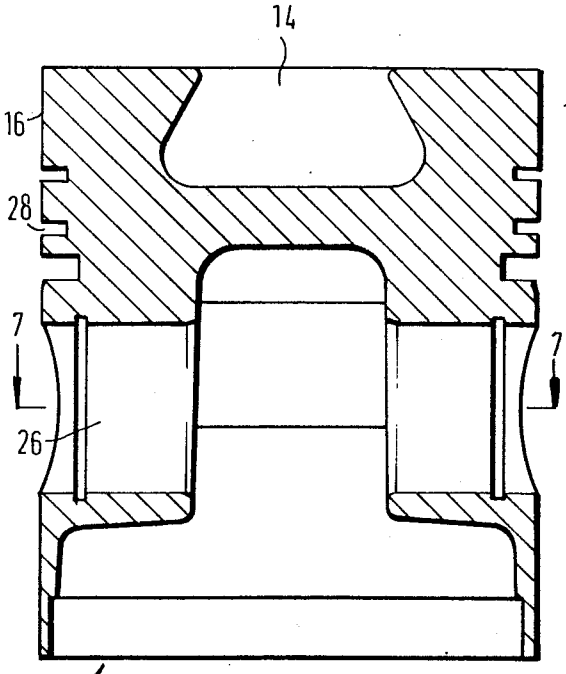
FIG. 5 is a longitudinal cross sectional view taken in the same direction as that of FIG. 2 but showing the finished piston after machining.
Figure 7:
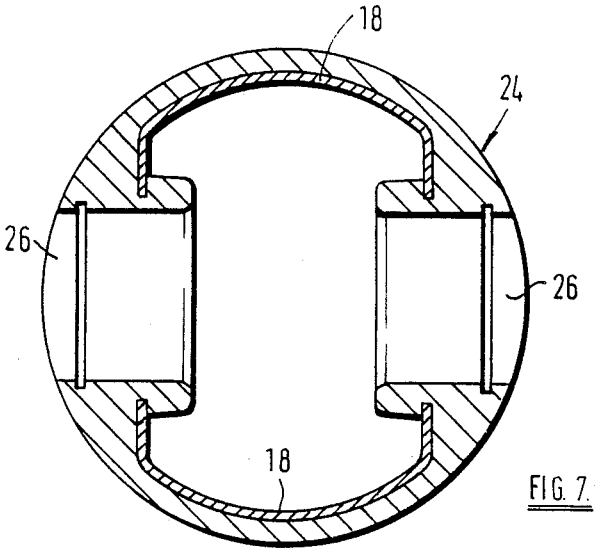

FIGS. 5 to 7 illustrate the fully finished machined piston 24 wherein the through bore 26 for receiving the gudgeon pin has been formed and piston ring grooves 28 have been cut into the peripheral surface of the crown region. A skimming operation has also been applied to the top surface of the crown 16 but the actual re-entrant bowl 14 has not been machined at all.

It will be appreciated that the invention is not restricted to the formation of the particular re-entrant bowl configuration shown in the accompanying drawings although the invention does find particular application in the squeeze forming of internal combustion engine pistons to the shape illustrated and described. Thus many shapes can be provided to a squeeze formed article by the provision of a suitably shaped compacted soluble salt core which will not chemically attack the metal to be squeeze formed and which will be of sufficient integrity and surface finish to withstand the pressures incurred during the squeeze forming operation and which will form a shape in the formed article which will not require any subsequent machining.

For example, a through bore could be provided in a squeeze formed link of an endless track assembly by providing a cylindrical shape of soluble core material within the mould cavity prior to the introduction of the molten metal therein. Alternatively, a saving may be made on the use of the soluble core material for the provision of a cylindrical through bore in a formed article by providing the soluble core material as a coating around a metal tube; the soluble coating subsequently being dissolved from the squeeze formed article thereby permitting the smaller diameter metal tube to be extracted.

I claim:

1. A method of manufacturing a light metal article in a squeeze forming press by squeeze forming molten metal in a mould of the press wherein:

a core comprising a non-sintered soluble salt cure, defining a required shape in the squeeze formed article, produced solely by isostatic compaction of a fine grained salt mixture to such a density and surface finish that it retains its integrity under the conditions of sustained temperature and pressure transmitted thereto by the metal during the squeeze forming operation, is located in a first mould part of the press prior to the introduction of molten metal thereto;

molten metal is introduced into said first mould part;

the mould is closed under pressure by a second mould part of the press to displace the molten metal to fill a die cavity defined between said first and second mould parts and the metal is maintained under pressure whilst solidification thereof takes place; and the mould is then opened, the squeeze formed metal article extracted and the core dissolved therefrom.

2. A method according to claim 1 wherein the salt core is isostatically compacted to the required shape to be formed in the squeeze formed article.

3. A method according to claim 1 wherein the salt core is isostatically compacted substantially to the required shape and is subsequently machined to the shape to be formed in the squeeze formed article.

4. A method according to any one of claims 1 wherein the salt core is isostatically compacted at a pressure of approximately 30,000 p.s.i. (207 MPa).

5. A method as claimed in claim 1 wherein the salt comprising the salt core is fine grained sodium chloride having a particle size of between 5 and 250 microns.

6. A method according to claim 1 wherein the salt comprising the salt core is mixed with a desiccant.

7. A method according to claim 1 wherein the salt comprising the salt core is mixed with an expansion modifying agent.

8. A method according to claim 7 wherein the expansion modifying agent is selected from the group comprising aluminium oxide, glass, copper alloy, graphite, talc and alumino-silicate.

9. A method according to claim 1 wherein the molten metal comprises aluminium or magnesium or an alloy thereof.

10. A method of manufacturing a light metal piston crown down bowl in a squeeze forming press by squeeze forming molten metal in a mould of the press wherein:

a core comprising a non-sintered soluble salt core, defining the shape of the bowl in the piston crown, produced solely by isostatic compaction of a fine grained salt mixture to such a density and surface finish that it retains its integrity under the conditions of sustained temperature and pressure transmitted thereto by the metal during the squeeze forming operation, is located in a fixed bottom mould part of the press prior to the introduction of molten metal thereto;

molten metal is introduced into said bottom mould part;

the mould is closed under pressure by a top punch of the press to displace the molten metal to fill a die cavity defined between the top punch and said bottom mould part and the metal is maintained under pressure whilst solidification thereof takes place; and the mould is then opened, the squeeze formed metal piston extracted and the core dissolved therefrom.

11. A method according to claim 10 wherein the salt core is shaped to provide a re-entrant bowl configuration in the piston crown.

12. A method according to claim 10 wherein the top punch is provided with magnetic holding means for supporting ferrous expansion inserts thereon for incorporation into the squeeze formed piston.

13. A method of manufacturing a light metal article in a squeeze forming press by squeeze forming molten metal in a mould of the press wherein:

a core comprising a non-sintered soluble salt core, defining a required shape in the squeeze formed article, produced solely by isostatic compaction of a mixture of fine grained sodium chloride, a desiccant and an expansion modifying agent to such a density and surface finish that it retains its integrity under the conditions of sustained temperature and pressure transmitted thereto by the metal during the squeeze forming operation, is located in a first mould part of the press prior to the introduction of molten metal thereto;

molten metal is introduced into said first mould part;

the mould is closed under pressure by a second mould part of the press to displace the molten metal to fill a die cavity defined between said first and second mould parts and the metal is maintained under pressure whilst solidification thereof takes place; and the mould is then opened, the squeeze formed metal article extracted and the core dissolved therefrom.

* * * * *